US005452647A

United States Patent [19]

Murakami et al.

[11] Patent Number: 5,452,647

[45] Date of Patent: Sep. 26, 1995

[54] WAVE PLATE TYPE COMPRESSOR

[75] Inventors: Kazuo Murakami; Kunifumi Goto; Masahiro Kawaguchi, all of Kariya, Japan

[73] Assignee: Kabushiki Kaisha Toyoda Jidoshokki Seisakusho, Kariya, Japan

[21] Appl. No.: 254,252

[22] Filed: Jun. 6, 1994

[30] Foreign Application Priority Data

Jun. 8, 1993 [JP] Japan ..... 5-137837

[51] Int. Cl.[6] ..... F01B 3/00; F16H 25/12

[52] U.S. Cl. ..... 92/71; 74/56; 74/57

[58] Field of Search ..... 92/71; 123/56.2, 123/55.3; 74/56, 57; 417/269

[56] References Cited

U.S. PATENT DOCUMENTS

| | | | |
|---|---|---|---|
| 2,205,953 | 6/1940 | Hall | 74/56 X |
| 2,243,822 | 5/1941 | Herrmann | 74/56 |
| 2,567,576 | 9/1951 | Palumbo | 74/56 |
| 3,374,684 | 3/1968 | Greven | 74/56 |
| 4,347,046 | 8/1982 | Brucken . | |
| 4,432,310 | 2/1984 | Waller | 74/56 X |
| 4,756,239 | 7/1988 | Hattori | 92/71 |
| 5,201,261 | 4/1993 | Kayukawa et al. | 92/71 |
| 5,218,933 | 6/1993 | Ehrlich | 123/56.2 X |

FOREIGN PATENT DOCUMENTS

| | | | |
|---|---|---|---|
| 57-110783 | 7/1982 | Japan | 417/269 |
| 10255 | 1/1993 | Japan | 417/269 |
| 106553 | 4/1993 | Japan | 417/269 |
| 149246 | 6/1993 | Japan | 417/269 |
| 157044 | 6/1993 | Japan | 417/269 |

*Primary Examiner*—John E. Ryznic
*Attorney, Agent, or Firm*—Brooks Haidt Haffner & Delahunty

[57] ABSTRACT

Disclosed is a compressor having a plate rotatable about an axis of a rotary shaft and a piston connected to the plate, wherein the plate causes the piston to reciprocate between a top dead center and a bottom dead center of its stroke in accordance with the rotation movement of the plate. A cam surface is provided with the plate for actuating the piston. A shoe engages with the plate for transmitting the rotation movement of the plate to the piston. A recess is formed on the piston for restricting rolling of the shoe on the plate for causing the shoe to slide on the plate to reduce the pressure caused by the contact between the cam surface and the shoe.

16 Claims, 9 Drawing Sheets

WAVE PLATE TYPE COMPRESSOR

BACKGROUND OF THE INVENTION

1. Field of the Invention

The present invention relates to wave plate type compressor in which pistons reciprocate due to the rotation of a solid cam shaped wave plate secured to a rotary shaft.

2. Description of the Related Art

In compressors of the type that use the rotating movement of a awash plate to reciprocate pistons in their associated cylinder bores, each piston reciprocates only once for each complete revolution the swash plate makes. One way to increase the compression displacement per rotation of the swash plate, is to design larger sized compressors. Since compressors however are often mounted in vehicles, their large design is distinctly undesirable.

One proposed solution to the above shortcoming is the recently developed wave plate type compressor disclosed in Japanese Unexamined Patent Publication No. 57-110783. This compressor design uses a solid cam shaped plate, having a surface that contains wave like undulations extending in a peripheral direction. The design of this plate thus varies from that of the conventional swash plate.

The conventional wave plate type compressor will now be briefly described with reference to FIG. 15. A pair of cam surfaces 51*a* and 51*b* having predetermined widths are provided at the periphery of the front and rear surfaces of a wave plate 51. Roller 53, 54 are rotatably supported between the cam surfaces 51*a*, 51*b* and a double-headed piston 52. The contact made between rollers 53, 54 and their respective cam surfaces 51*a* and 51*b* is in a widthwise direction across the cam surfaces. When the wave plate 51 turns, therefore, the rollers 53, 54 roll on the cam surfaces 51*a* and 51*b*, so that the displacement of the cam surface 51*a*, caused by the rotation of the wave plate 51, is transmitted via the rollers 53, 54 to the double-headed piston 52. This in turn, causes the piston 52 to reciprocate. The cycle with which the piston 52 reciprocates can be represented according to a displacement curve of the wave plate's cam surfaces 51*a* and 51*b*. With a two cycle curve, when there are two portions on the displacement curve corresponding to top and bottom dead center positions of the piston 52, the piston 52 reciprocates twice to perform two compression cycles. During this time, the wave plate 51 makes only one complete revolution.

The above wave plate type compressor has the following disadvantages. The rollers 53, 54 are rotatably supported by the piston in such a way as to roll over the cam surfaces as the wave plate 51 turns. However, when the support portions of the piston 52 cause the rollers 53, 54 to experience a frictional resistance larger than the frictional resistance produced by the wave plate 51, the roller 53, 54 slide on the wave plate 51.

Also, the peripheral velocity, at the center of the wave plate 51 differs from that at the periphery of plate 51. The amount of the aforementioned slide tends to be more pronounced at the periphery portions of each cam surface 51*a*, 51*b* and of the wave plate 51. To promote the smooth rolling of the rollers 53, 54, a clearance is provided between the piston 52 and the rollers 53, 54. If uneven sliding occurs between the rollers 53, 54 and the associated cam surfaces, the axes of the rollers 53, 54 become inclined with respect to the wave plate 51. As a result, the rollers 53, 54 or the support portions of the pistons 52 tend to wear out quickly. This in turn contributes to the generation of compressor vibration and noise.

Furthermore, due to the limited diameters and lengths of the rollers 53, 54, the area over which the rollers 53, 54 contact the wave plate 51 is quite small. Consequently, when the piston 52 that supports the rollers 53, 54 receives a relatively large reaction force, due for example to changes in the compressor's internal gas pressure, the contact pressure of the rollers 53, 54 against the wave plate 51 is very high per unit area. This contributes to the aforementioned undesirable wearing characteristics of the rollers 53, 54 and support portions of the pistons 52.

SUMMARY OF THE INVENTION

The present invention has been achieved with a view to solving the above disadvantages, and it is an object of the present invention to provide a wave plate type compressor in which a wave plate can have enhanced wear resistance.

To achieve the above object, according to a wave plate type compressor embodiment of this invention, a piston is provided that repeatedly reciprocates in an associated cylinder bore between top and bottom dead centers of its stroke while the wave plate rotates once compressing gas inside the cylinder bore. A cam surface is formed at the periphery of the wave plate. When the wave plate turns, a transmission member or a shoe is displaced based on the shoe's engagement with the cam surface. The shoe's displacement is transmitted to the piston. A recess is provided between the piston and the transmission member, which restricts the rolling of the shoe on the wave plate and permits the shoe to slide on the wave plate when the wave plate turns.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 5(*b*) is a perspective view of the shoe shown in FIG. 5(*a*);

Figure 11:
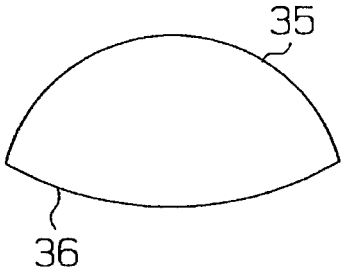
FIGS. 11(*a*) end 11(*b*) illustrate another example of the shoe contemplated by the present invention, FIG. 11(*a*)
Figure 11:
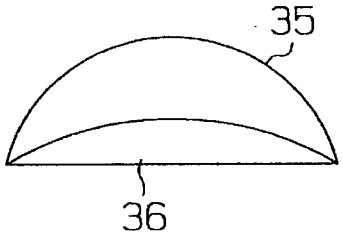
Figure 12:
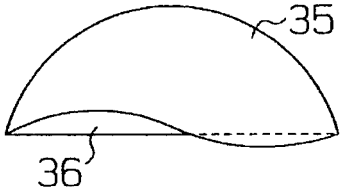
Figure 13:
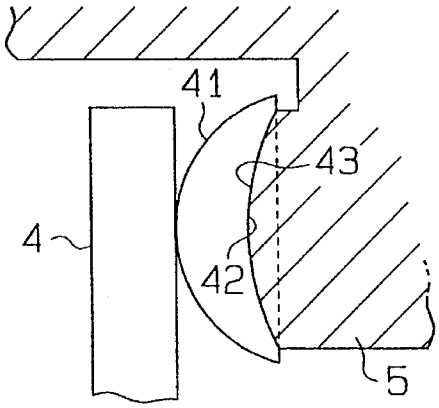
Figure 14:
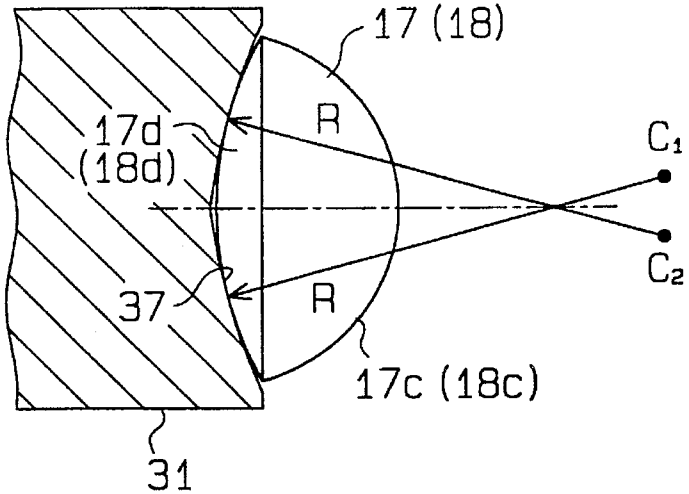
Figure 15:
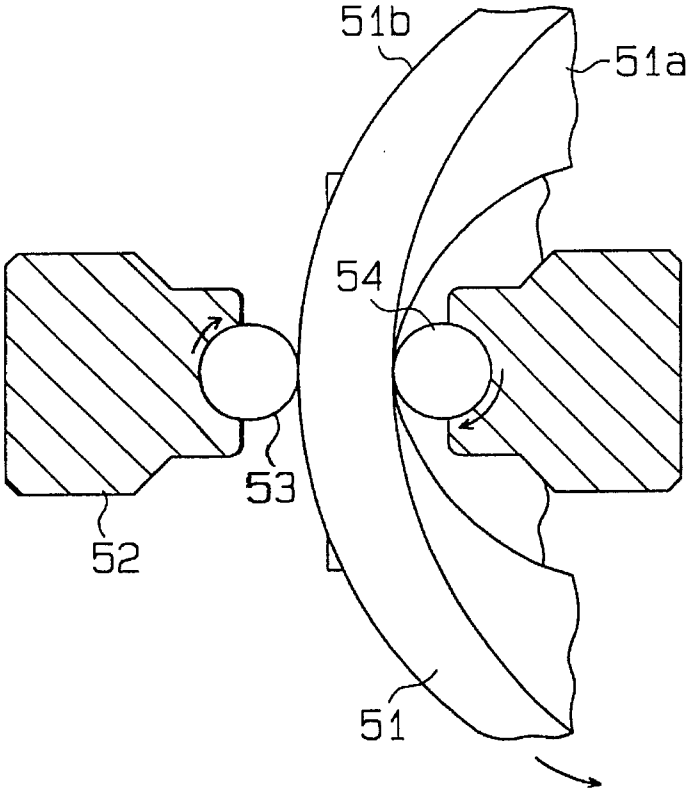
Fig. 15 (Prior Art)

shows a front view of the shoe while FIG. 11(*b*) is an oblique view showing the underneath side of the shoe;

FIG. 12 is a front view showing a further example of the shoe;

FIG. 13 is a side cross-sectional view showing a still further example of the shoe and another example of the piston;

FIG. 14 is a partial cross-sectional view of a wave plate of the second embodiment modified to include a substantially v-shaped groove formed therein; and FIG. 15 is a partially cross-sectional view of a conventional wave plate type compressor.

DETAILED DESCRIPTION OF THE PREFERRED EMBODIMENTS

First Embodiment

A first embodiment of the present invention will now be described referring to the accompanying drawings.

Figure 1:
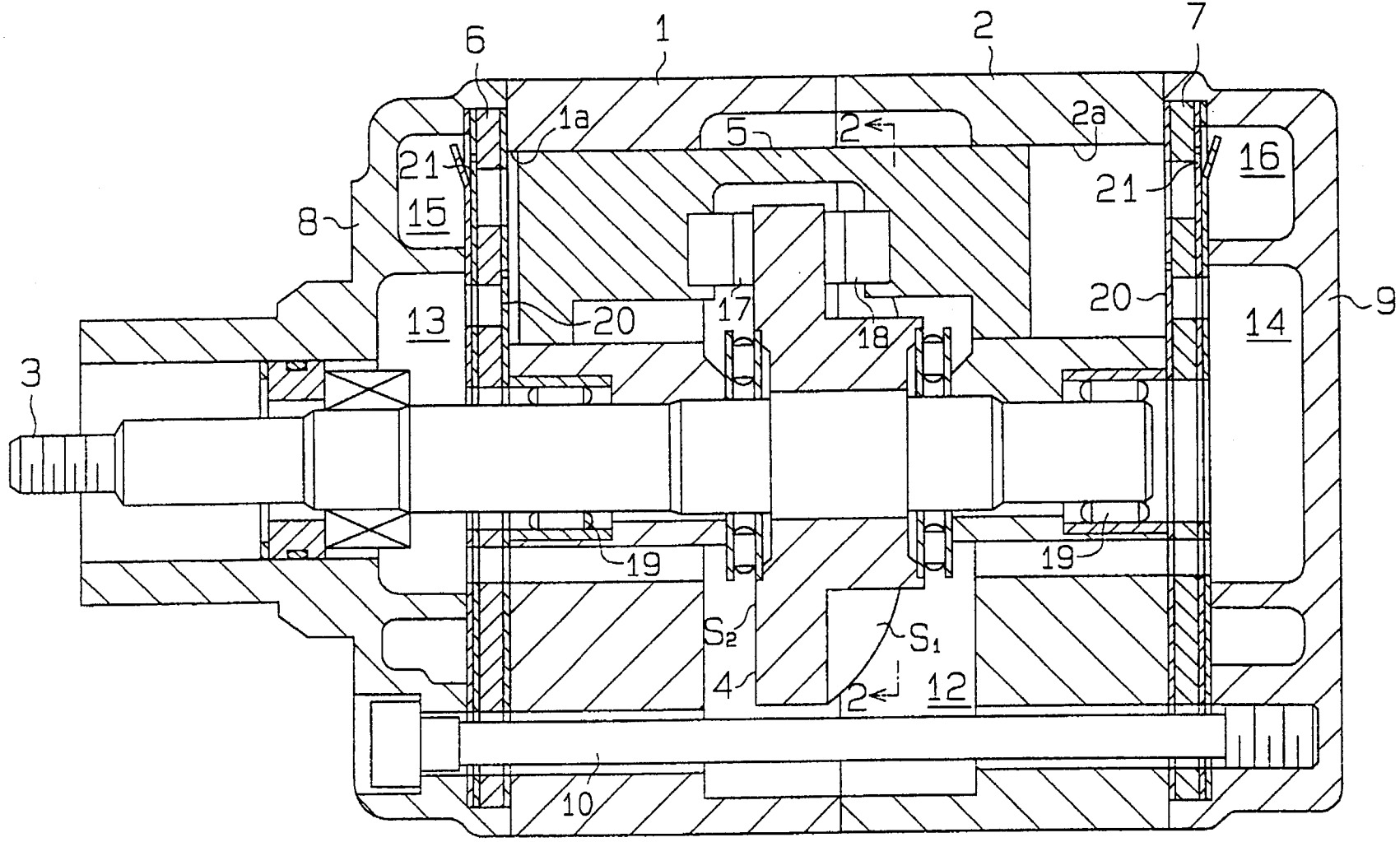
FIG. 1 is a side cross-sectional view of a compressor according to a first embodiment of the present invention.
Figure 2:
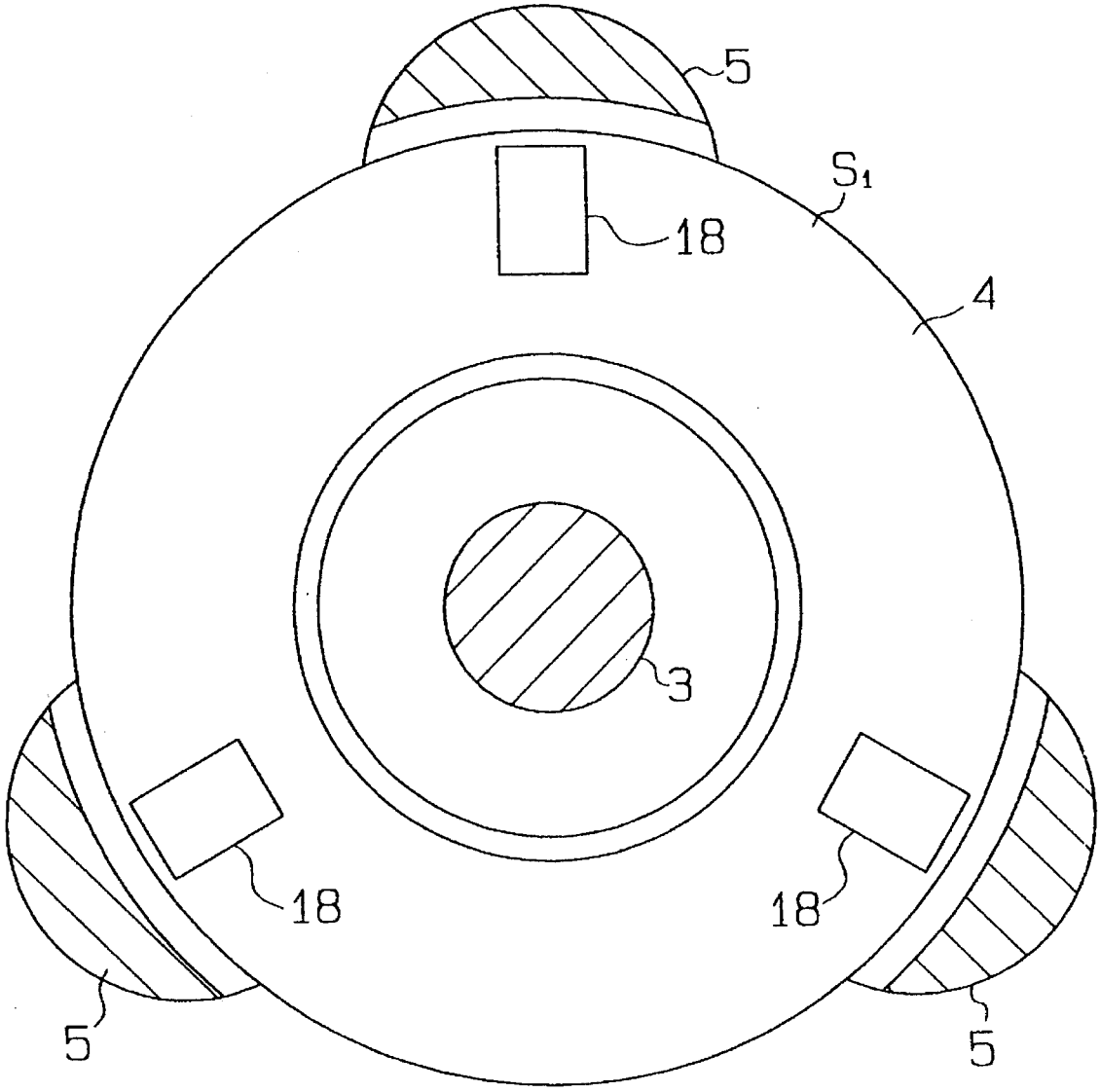
FIG. 2 is a cross section taken substantially along the line 2—2 in FIG. 1.
Figure 3:
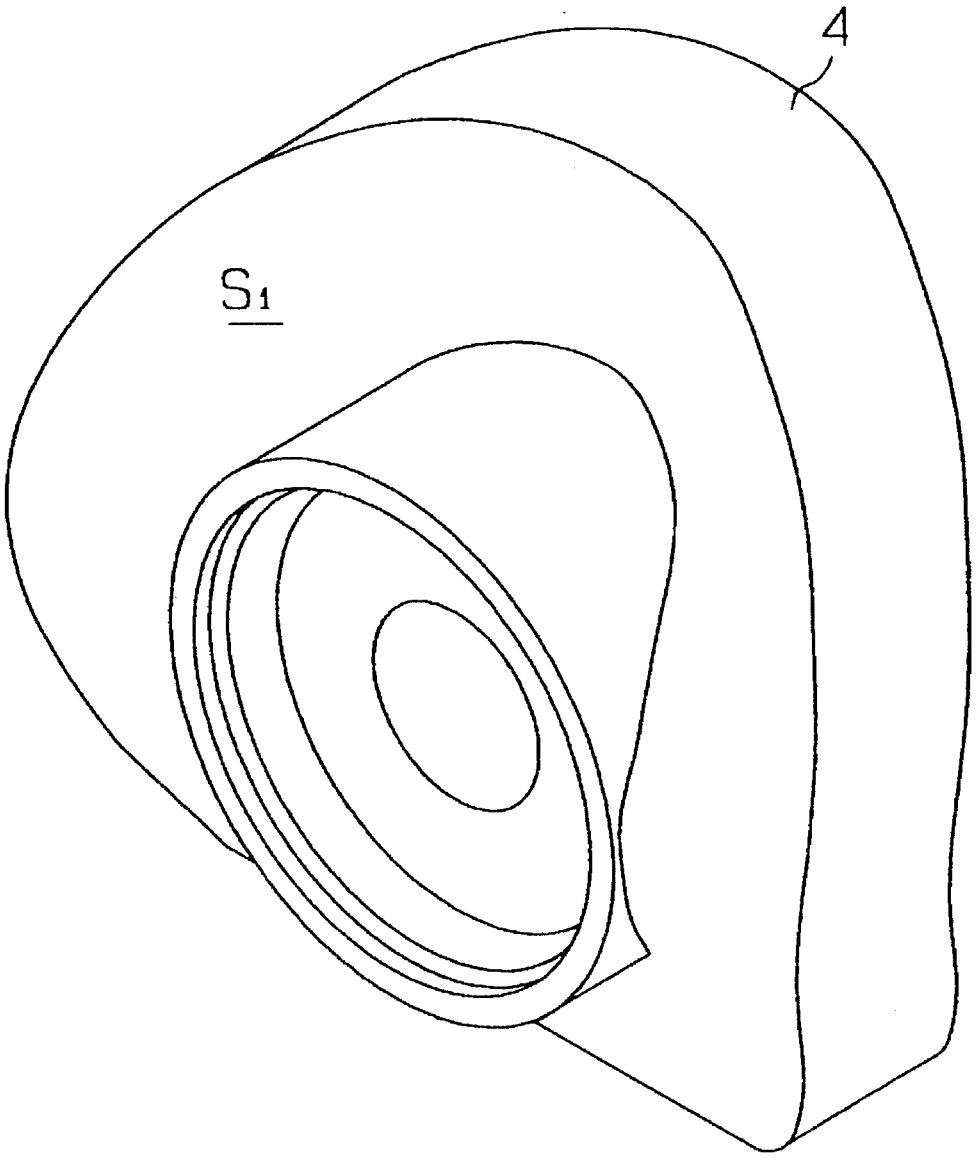
FIG. 3 is a perspective view schematically showing a wave plate of the compressor shown in FIG. 1.

As shown in FIG. 1, a shaft 3 is rotatably supported via bearings 19 in a pair of cylinder blocks 1 and 2 which are secured to each other. A wave plate 4 having a solid cam shape is secured on the shaft 3. The wave plate 4 has cam surfaces S1 and S2 formed at its periphery.

A plurality of bores 1*a* and 2*a*, respectively formed in the cylinder blocks 1 and 2, are equiangularly spaced around the shaft 3 at peripheral portions of cylinder blocks 1 and 2. The bores 1*a* of the front cylinder block 1 make pairs with the associated bores 2*a* of the rear cylinder block 2, thereby forming a plurality of cylinder bores. A plurality of double-headed pistons 5 are reciprocatably retained in the associated cylinder bores. Both cam surfaces S1 and S2 are formed on the basis of a 2-cycle displacement curve, and each have two portions respectively corresponding to the top dead center and bottom dead center of the strokes of the pistons 5. Each piston 5 therefore reciprocates twice to execute two compression cycles for every revolution made by the wave plate 4.

A front housing 8 and a rear housing 9 are arranged at the outer ends of the cylinder blocks 1 and 2 via valve plates 6 and 7, respectively, and are secured to the cylinder blocks 1 and 2 respectively by bolts 10. Defined in both housings 8 and 9 are suction chambers 13 and 14 and discharge chambers 15 and 16. The suction chambers 13 and 14 respectively communicate with the bores l*a* and 2*a* using inlet valves while the discharge chambers 15 and 16 respectively communicate with the bores l*a* and 2*a*, using discharge valves 21. A wave plate chamber 12, provided substantially at the center between the housing 8 and 9, communicates with the suction chambers 13 and 14 as well as the discharge chambers 15 and 16. The wave plate chamber 12 is also connected to a refrigerator circuit's evaporator (not shown).

Figure 4:
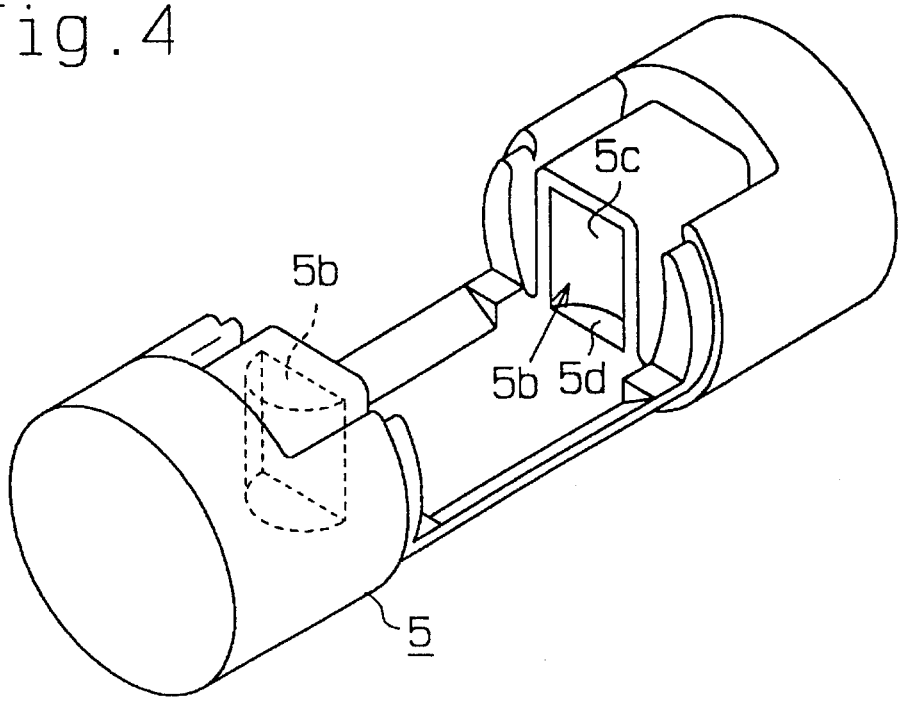
FIG. 4 is a perspective view of one of pistons in the compressor shown in FIG. 1.

As shown in FIGS. 1 and 4, a pair of recesses 5*b* are formed in the piston 5 opposing the front and rear cam surfaces S1 and S2 of the wave plate 4. Each recess 5*b* has three walls, one of which is a cylindrical surface 5*c* that faces the cylindrical surface 5*c* of the other recess 5*b*. The other two walls are flat and are located on both ends 5*d* of the cylindrical surface 5*c*, opposing each other. Shoes 17 and 18 are supported in the respective recesses 5*b* and engage the cam surfaces S1 and S2 on both sides of the wave plate 4. The cylindrical surface 5*c* is formed around a line perpendicular to the axis of the shaft 3.

Figure 5:
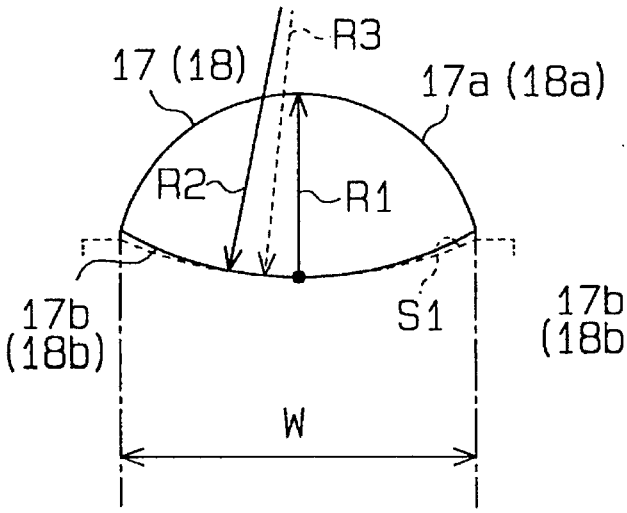
FIG. 5(*a*) is a plan view of a shoe in the compressor shown in FIG. 1.
Figure 5:
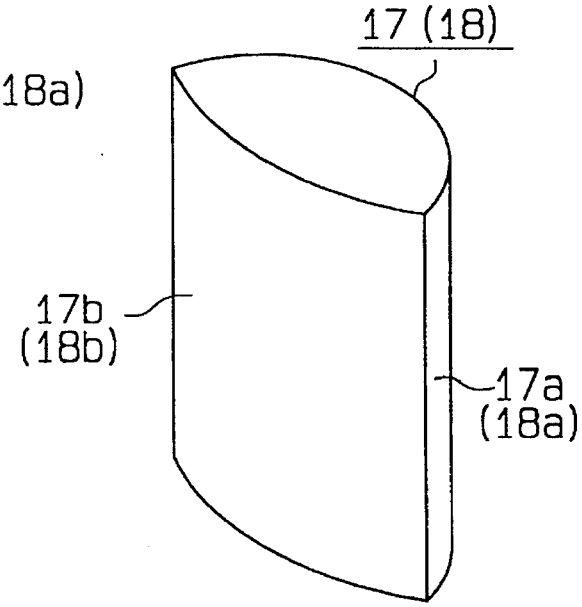
Figure 6:
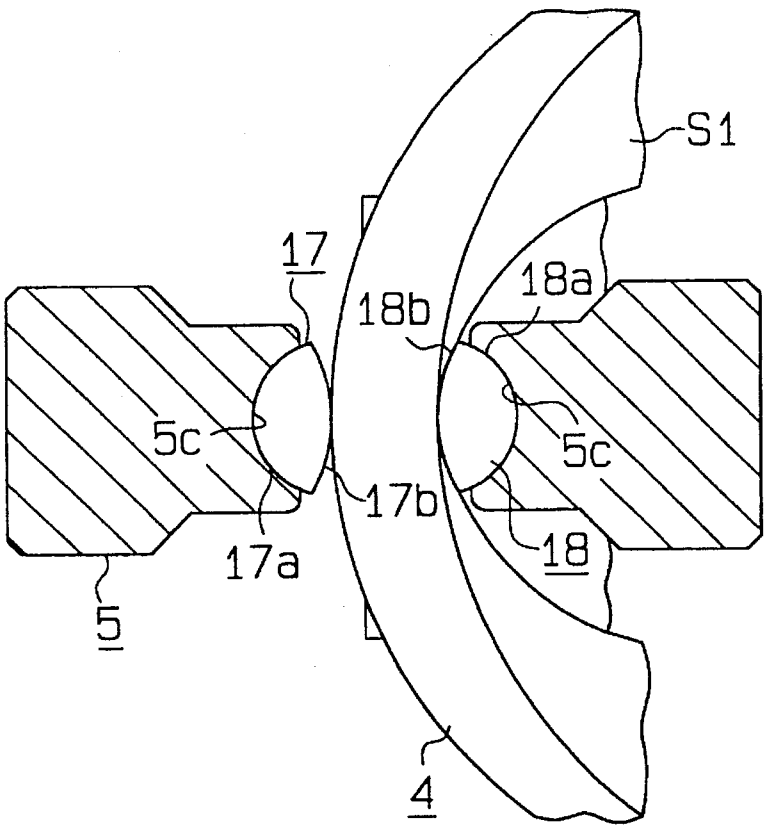
FIG. 6 is a partial cross-sectional view showing the shoes provided between the wave plate and the piston in the compressor in FIG. 1.

As shown in FIG. 5(*a*) and 5(*b*), the shoe 17 has first and second surfaces 17*a* and 17*b*, while the shoe 18 has first and second surface 18*a* and 18*b*. The first surfaces 17*a* and 18*a* engage with the cylindrical surface 5*c* of the piston 5. The second surfaces 17*b* and 18*b* have a radius of curvature R2 larger than the radius of curvature, R1, of the first surfaces 17*a* and 18*a*, and engage with the cam surfaces S1 and S2, respectively. The radius of curvature R1 of the first surfaces 17*a* and 18*a* is the same as the radius of curvature of the cylindrical surface 5*c* of the piston 5. No clearance is provided between the first surfaces 17*a* and 18*a* end the associated cylindrical surfaces 5*c*. The length of the shoes 17 and 18 is equal to the distance between the flat walls 5*d* of the recess 5*b*.

With the shoes 17 and 18 received in the associated recesses 5*b*, the centers of the first surfaces 17*a* and 18*a* of the shoes 17 and 18 match with the centers of the cylindrical surfaces 5*c*. As the wave plate 4 turns, the shoes 17 and 18 slide along the cylindrical surfaces 5*c* around their axes in accordance with the engagement of their second surfaces 17*b* and 18*b* with the cam surfaces S1 and S2.

As apparent from FIG. 5(*a*), the width W of each of the shoes 17 and 18 (the length of each of the chords of the first surfaces 17*a* and 18*a* and the second surfaces 17*b* and 18*b*) is larger than the distance from the deepest portion of the cylindrical surface 5*c* to the cam surface S1 or S2 of the wave plate 4. Accordingly, the shoes 17 and 18 are constrained to maintain the engagement of the second surfaces 17*b* and 18*b* with the respective cam surfaces S1 and S2. The cylindrical surfaces 5*c* consequently permit the shoes 17 and 18 to slide in the associated recesses 5*b*. This restrict the rolling of the shoes 17 and 18 on the respective cam surfaces S1 and S2. The radius of curvature R2 of the second surface 17*b* or 18*b* is equal to or slightly smaller than the radius of curvature, R3, of the cam surface S1 or S2 at one portion corresponding to the bottom dead center of the piston stroke. The ratio R3 to R2 is preferably in the range from 1.1 to 1.

The function of the thus constituted compressor will now be described below.

When the wave plate 4 turns with the rotation of the shaft 3, the double-headed piston 5 reciprocates in the bores l*a* and 2*a* due to the engagement of the shoes 17 and 18 with the wave plate 4. This action effectively accomplishes the suction, compression and discharge of a fluid. During these operations, the shoes 17 and 18 have only a slight sliding movement in the recesses 5*b* across the cam surfaces S1 and S2 of the wave plate 4.

According to this embodiment, when the wave plate 4 turns, the shoes 17 and 18 will not roll on the respective cam surfaces. In addition, since no clearances exists between the first surfaces 17*a* and 18*a* and the cylindrical surfaces 5*c*, were a force tilting the axes of the shoes 17 and 18 to be applied to the shoes, the force would be received by the cylindrical surfaces 5*c*. This prevents the shoes 17 and 18 from tilting inside the recesses 5*b*, which in turn improves the resistance of the second surfaces 17*b* and 18*b* to wearing. It is therefore possible to prevent the occurrence of vibration or noise due to the local wearing.

Since it is unnecessary to roll the shoes 17 and 18 on the cam surfaces S1 and S2, the radii of curvature of the second surfaces 17*b* and 18*b* of the shoes 17 and 18 can be increased. When sufficient pressure is applied to the shoes 17 and 18 and the wave plate 4, squeeze deformation will occur during the compressor's operation. This creates a so-called Mertz's or planar contact between the shoes 17 and 18 and the wave plate 4, and increases the contact area shared therebetween. As a result, the contact pressure between the wave plate 4 and shoes 17 and 18 per unit area decreases, thus further enhancing their wear resistance.

In addition, the radii of curvature of the second surfaces 17*b* and 18*b* are set substantially equal to the radii of curvature of the cam surfaces S1 and S2 at the portions corresponding to the bottom dead center of the piston stroke in this embodiment. It is therefore possible to maximize the radii of curvature of the second surfaces 17*b* and 18*b* to further increase the contact areas between the cam surfaces S1 and S2 and the second surfaces 17*b* and 18*b* at the time the squeeze deformation occurs.

Second Embodiment

A second embodiment of the present invention will now be described with reference to FIGS. 7 through 10. The second embodiment differs from the first embodiment in the structures of the wave plate and shoes. Accordingly, the same or similar reference numerals as used in this first embodiment will be used in the second embodiment to denote identical or similar elements common to both embodiments, in order to avoid their repetitive descriptions.

Figure 7:
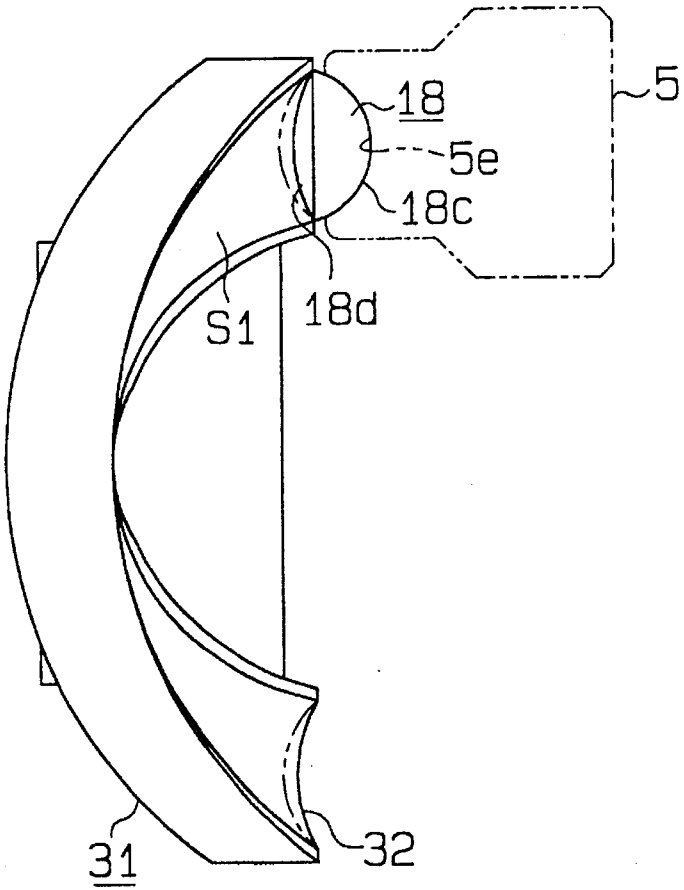
FIG. 7 is a partial plan view of a second embodiment of the present invention, showing a wave plate having a groove formed in a cam surface and a shoe with the groove.
Figure 8:
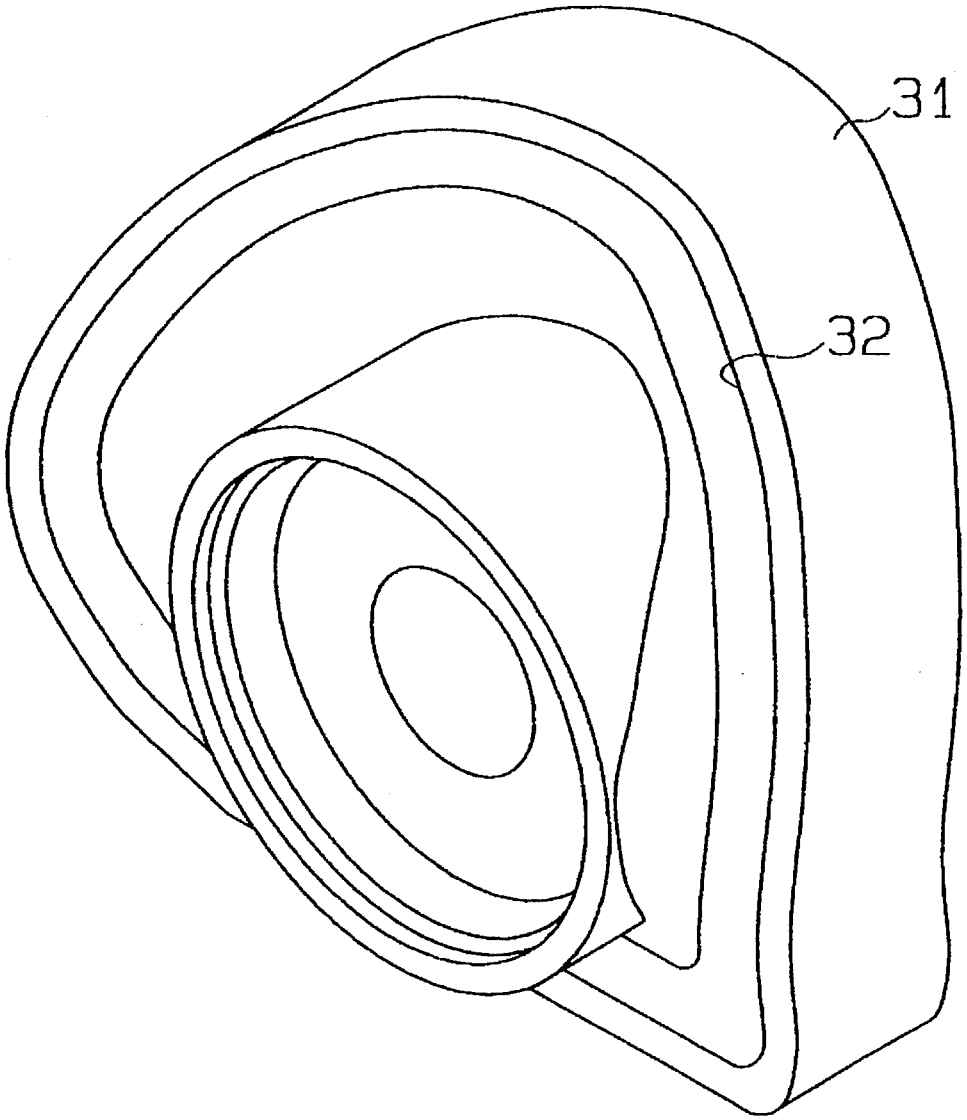
FIG. 8 is a perspective view schematically showing the wave plate according to the second embodiment.
Figure 9:
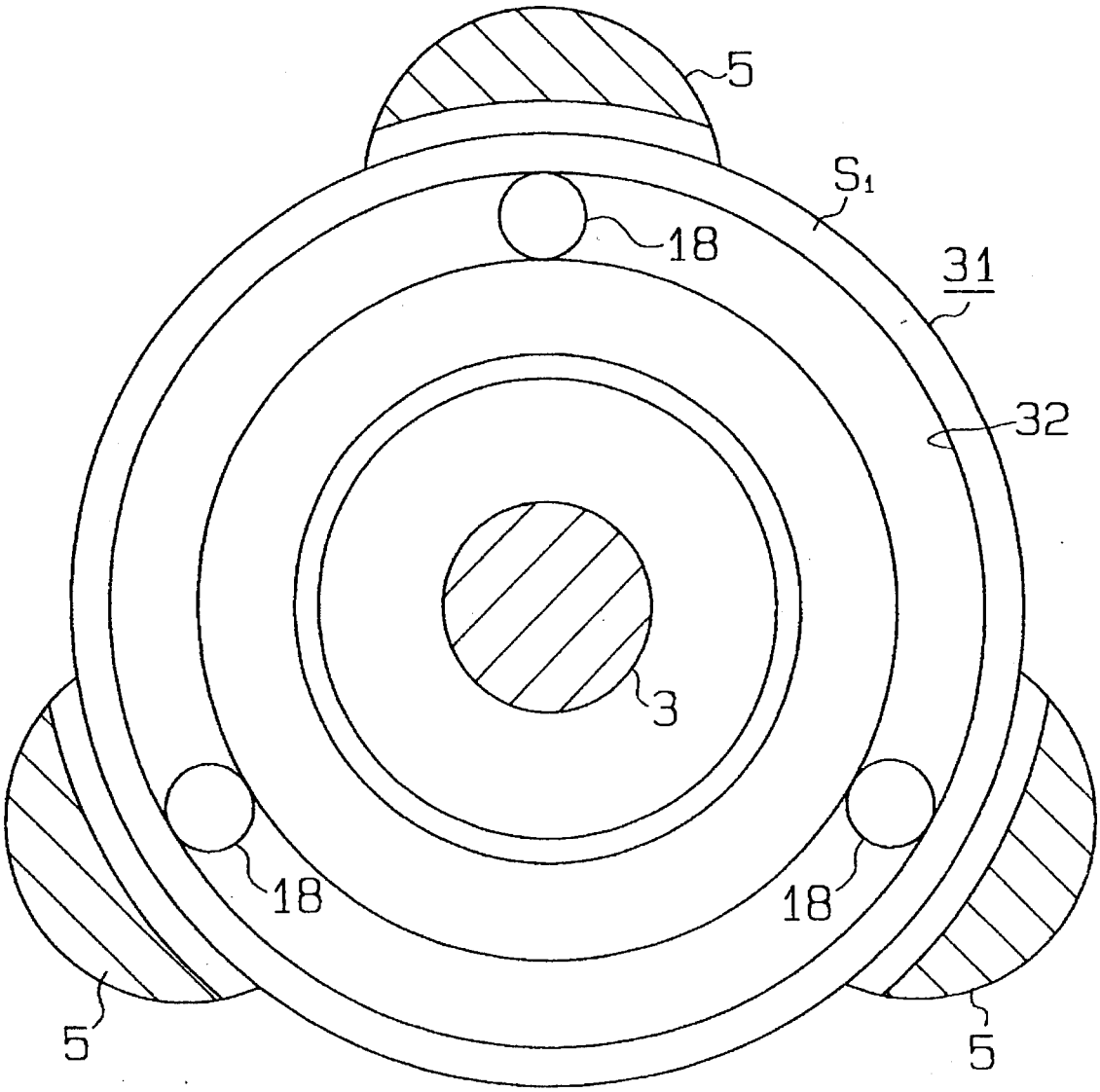
FIG. 9 is a front view of the wave plate according to the second embodiment.

FIG. 8 is a perspective view schematically showing a wave plate 31 according to the second embodiment. As shown in FIGS. 8 end 9, an annular groove 32 is formed in each of the cam surfaces S1 and S2 around the rotational center of the wave plate 31. The groove 32 has an arcuate cross section as seen in FIG. 7. As shown in FIGS. 7 and 9, shoes 17 and 18 (only one shoe 18 is shown) engage with their respective cam surfaces S1 and S2. As apparent from FIGS. 10(*a*) to 10(*c*), the shoes 17 and 18 have spherical first surfaces 17*c* and 18*c* and spherical second surfaces 17*d* and 18*d*. The second surfaces 17*d* and 18*d* have radii larger than those of the first surfaces 17*c* and 18*c*. The piston has portions 5*e*(FIG. 7) for supporting the shoes 17 and 18 similar to that of the cylindrical surfaces 5*c* in the first embodiment. The portions 5*e* are formed spherical to match with the first surfaces 17*c* and 18*c* as indicated by a chain double-dashed line in FIG. 7. The second surfaces 17*d* and 18*d* of the shoes 17 and 18 are engaged with the grooves 32. The radius of the groove 32 at the arcuate cross section is substantially the same as that of the second surface 17*d* or 18*d* of the shoe 17 or 18. This allows the aforementioned Hertz's contact to be established between the shoes 17 and 18 and the grooves 32. Consequently, a planar contact can be maintained over a linear area.

In the second embodiment, as in the first embodiment, when the wave plate 31 turns, the shoes 17 and 18 will not roll on the respective cam surfaces S1 and S2. Further, the contact pressure per unit area can be reduced by increasing the contact areas both between the grooves 32 in the cam surfaces S1 and S2 of the wave plate 31 and between the second surfaces 17*d* end 18*d* of the shoes 17 and 18. It is therefore possible not only to improve the wear resistance of the shoes 17 and 18 and the pistons 5, but also to suppress the occurrence of vibration or noise resulting from their premature wearing.

The present invention is not limited to the above-described embodiments, but parts of the structure may be modified as needed in the following manner without departing from the spirit or scope of the invention.

The shoes 17 and 18 may be formed integrally with the double-headed pistons 5.

Figure 10:
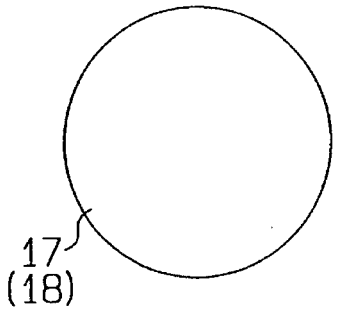
FIGS. 10(*a*) to 10(*c*) are respectively a plan view, a front view and a side view showing another example of the shoe.
Figure 10:
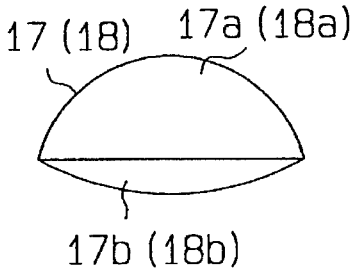
Figure 10:
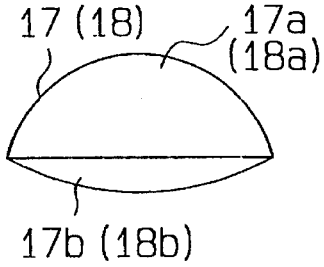

The shoes of the second embodiment as shown in FIGS. 10(*a*) to 10(*c*) may be combined with the cam surfaces in the first embodiment. In this case as in the first two embodiments, the contact between shoes and wave plate would be planar due to the Hertz's contact, so that sufficient contact areas between the shoes and wave plate could be assured.

As shown in FIGS. 11(*a*) and 11(*b*), the shoe may have a spherical first surface 35 and a cylindrical second surface 36.

As shown in FIG. 12, the second surfaces 36 of the shoes 17 and 18 may be formed with a radius of curvature that conforms to portions of the cam surfaces S1 and S2 during times when the stroke of the pistons is at bottom dead center.

The shapes of the second surfaces 17*d* and 18*d* of the shoes 17 and 18 and the cross-sectional shape of each groove 32 may be formed having an oval shape as indicated by a chain double-dashed line in FIG. 7 or other shapes.

As shown in FIG. 13, a shoe 41 may have a spherical recess 42 and the piston 5 may have a projection 43 that engages with the recess 42, so that the shoe 41 is supported by this engagement.

The grooves 32 formed in the wave plate 31 of the second embodiment may be modified in the following manner. As shown in FIG. 14, a groove 37 may have a cross section formed along a so-called Gothic radius that is provided with two arcs and has two different centers C1, C2 of the same radius R.

What is claimed is:

1. A compressor having a plate rotatable about an axis of a rotary shaft and a piston connected to the plate, wherein the plate causes the piston to reciprocate between a top dead center and a bottom dead center of the piston stroke in accordance with the rotation movement of the plate, said compressor comprising:

cam means provided on the plate for actuating the piston to reciprocate a plurality of times responsive to each revolution of the plate.

transmission means engaging with the cam means for transmitting the rotation movement of the plate to the piston;

means, interposed between said piston and said transmission means, for restricting rolling of said transmission means on said cam means for causing said transmission means to slide on said cam means to reduce the pressure caused by the contact between said cam means and said transmission means.

2. A compressor according to claim 1, wherein said transmission means includes a shoe provided separately from said piston.

3. A compressor according to claim 2, wherein said shoe has a surface engageable with said cam means of said plate.

4. A compressor according to claim 2, wherein said cam means has a first portion and a second portion for driving the piston toward said top dead center and said bottom dead center, respectively, said second portion being a surface having a radius of curvature, and said shoe has a first surface having a radius of curvature substantially equal to said radius of curvature of said second portion of the cam means.

5. A compressor according to claim 3, wherein said first surface of said shoe engageable with said second portion of said cam means is cylindrical.

6. A compressor according to claim 3, wherein said first surface of said shoe engageable with said second portion of said cam means is spherical.

7. A compressor according to claim 2, wherein said interposed means includes a recess formed in said piston to retain said shoe, and said shoe is movable in said recess.

8. A compressor according to claim 7, wherein said recess has an inner wall in the form of a spherical surface, and said shoe has a second surface engageable with said inner wall.

9. A compressor according to claim 7, wherein said recess has a inner wall having a cylindrical shape, and said shoe has a second surface engageable with said inner wall.

10. A compressor according to claim 9, wherein said second surface of said shoe is a cylindrical surface having a radius of curvature, and said first surface of said shoe engageable with said cam means has a radius of curvature larger than that of said second surface of said shoe engageable with said inner wall.

11. A compressor according to claim 6, wherein said cam means has a groove having an arcuate cross section.

12. A wave plate type compressor having a wave plate rotatable about an axis of a rotary shaft and a piston connected to the plate, wherein the wave plate causes the piston to reciprocate between a top dead center and a bottom dead center of its stroke in accordance with the rotation movement of the plate, said compressor comprising:

cam means provided on said wave plate for actuating the piston to reciprocate a plurality of times responsive to each revolution of the plate.

a shoe engaging with said cam means for transmitting the rotation movement of the plate to the piston; and a recess provided in said piston receiving said shoe, said recess restricting rolling of said shoe on said cam means for causing said shoe to slide on said cam means to reduce the pressure caused by the contact between said cam means and said shoe.

13. A compressor according to claim 12, wherein said shoe has a cylindrical first surface engageable with said cam means.

14. A compressor according to claim 13, wherein said recess has an inner wall in a cylindrical shape having a radius of curvature, and said shoe has a second surface engageable with said inner wall.

15. A compressor according to claim 14, wherein said second surface of said shoe is cylindrical having a radius of curvature, and said cylindrical first surface of said shoe engageable with said cam means has a radius of curvature larger than said radius of curvature of said second surface of said shoe engageable with said inner wall.

16. A compressor according to claim 12, wherein said cam means has a first portion and a second portion for driving the piston toward said top dead center and said bottom dead center, respectively, said second portion being a surface having a radius of curvature and said shoe has a first surface with a radius of curvature substantially equal to said radius of curvature of said portion.

* * * * *

UNITED STATES PATENT AND TRADEMARK OFFICE

CERTIFICATE OF CORRECTION

PATENT NO. : 5,452,647

DATED : September 26, 1995

INVENTOR(S) : K. Murakami et al

It is certified that error appears in the above-identified patent and that said Letters Patent is hereby corrected as shown below:

Column 1, line 53, "roller" should read --rollers--.

Column 3, line 52, "housing" should read --housings--.

Column 4, line 10, "end" should read --and--;
line 31, "restrict" should read -- restricts--;
line 66, "Mertz's" should read --Hertz's--.

Column 6, line 36, "plate." should read --plate;--.

Column 7, line 22, "plate." should read --plate;--.

Signed and Sealed this

Twelfth Day of March, 1996

Bruce Lehman

*Attest:*

BRUCE LEHMAN

*Attesting Officer*

*Commissioner of Patents and Trademarks*